United States Patent [19]

Djordjevic

[11] Patent Number: 4,667,641

[45] Date of Patent: May 26, 1987

[54] INJECTION PUMP WITH RADIALLY MOUNTED SPILL CONTROL VALVE

[75] Inventor: Ilija Djordjevic, Windsor, Conn.

[73] Assignee: Stanadyne, Inc., Windsor, Conn.

[21] Appl. No.: 905,469

[22] Filed: Sep. 10, 1986

Related U.S. Application Data

[63] Continuation-in-part of Ser. No. 779,201, Sep. 23, 1985, which is a continuation-in-part of Ser. No. 658,887, Oct. 9, 1984, Pat. No. 4,552,117.

[51] Int. Cl.[4] ..... F02M 59/12; F02M 59/20

[52] U.S. Cl. ..... 123/502; 123/506; 417/462

[58] Field of Search ..... 123/450, 501, 502, 506; 417/462

[56] References Cited

U.S. PATENT DOCUMENTS

| | | | |
|---|---|---|---|
| 3,759,239 | 9/1973 | Regneault et al. | 123/506 |
| 3,857,374 | 12/1974 | Glikin et al. | 123/506 X |
| 4,366,796 | 1/1983 | Kaibara et al. | 123/502 |
| 4,550,702 | 11/1985 | Djordjevic | 123/450 |
| 4,552,117 | 11/1985 | Djordjevic | 123/506 |
| 4,573,444 | 3/1986 | Howes | 123/502 |

*Primary Examiner*—Tony M. Argenbright

*Attorney, Agent, or Firm*—Chilton, Alix & Van Kirk

[57] ABSTRACT

A rotary fuel injection pump (10) having a rotating spill control valve (37) mounted transversely in the rotor (16), adjacent the charge pump (39). The valve is centered on the longitudinal axis of the rotor and connected to the center of the pumping chamber by a short pump passage (43). Pressurized fuel from the pumping chamber is forced through the pump passage and a transverse bore (170) in the center of the spill valve, into an outlet passage (46) for delivery to the outlet nozzle. The forces on the valve are balanced during this injection event. Inlet fuel enters the valve bore and passes through the spill valve through another transverse bore (171), which is fluidly connected to the pump passage. A simplified spill pressure regulating valve (139, 141) and a dual piston cam ring timing adjustment arrangement (326, 328) are also disclosed.

27 Claims, 42 Drawing Figures

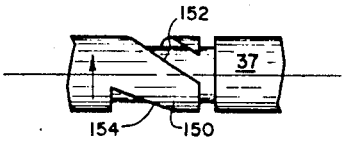
FIG. 5
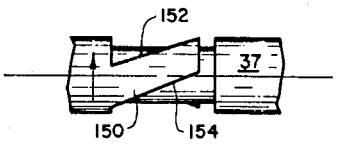
FIG. 6
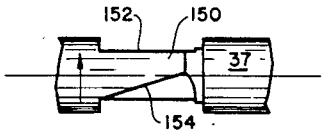
FIG. 7
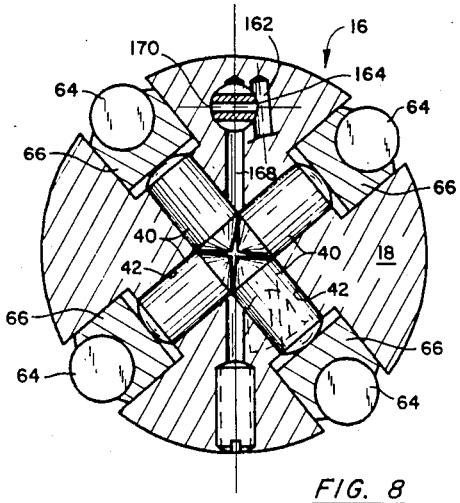
FIG. 8
FIG. 9
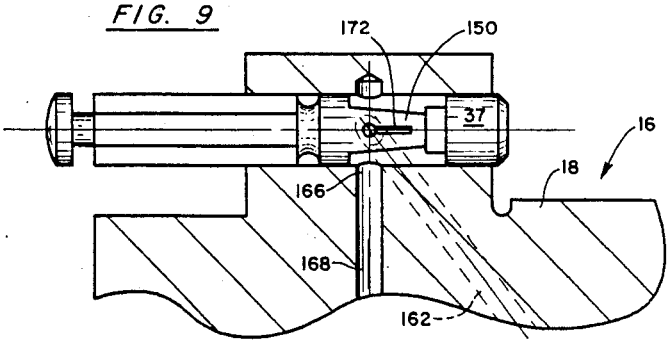

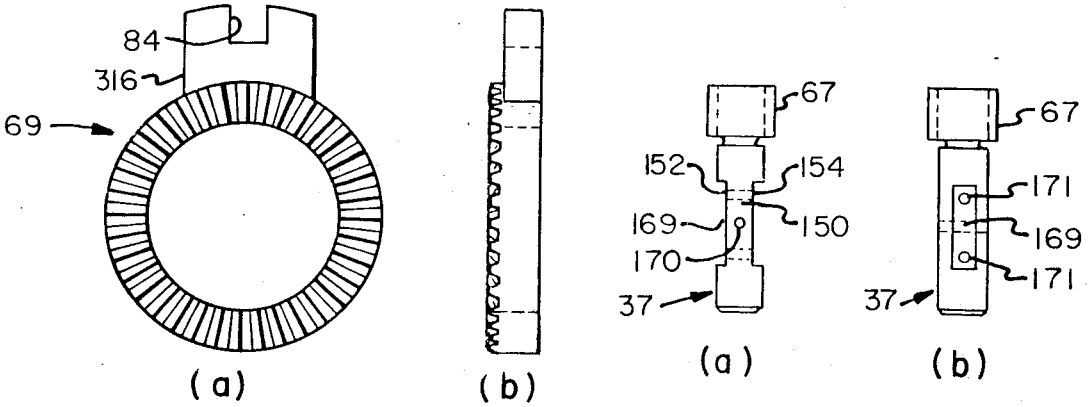
Fig. 34
Fig. 32
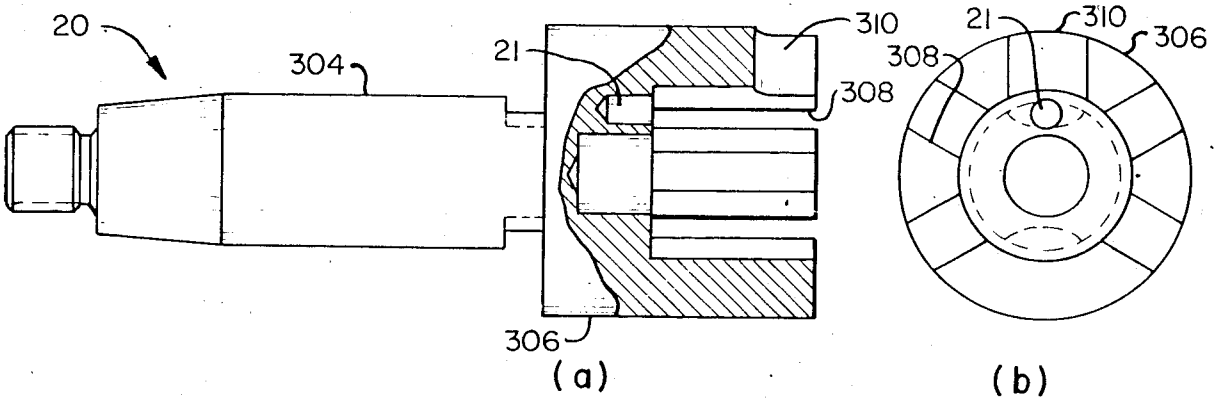
Fig. 33

INJECTION PUMP WITH RADIALLY MOUNTED SPILL CONTROL VALVE

RELATED APPLICATION

The present application is a continuation-in-part of copending application Ser. No. 779,201 filed Sept. 23, 1985, and entitled "Fuel Injection Pump With Spill Control Mechanism", which is a continuation-in-part of application Ser. No. 658,887, filed Oct. 9, 1984, now U.S. Pat. No. 4,552,117 issued Nov. 12, 1985.

BACKGROUND AND SUMMARY OF THE INVENTION

The present invention relates generally to fuel injection pumps of the type having a rotary charge pump with one or more reciprocating pumping plungers for sequentially supplying measured charges of fuel under high pressure to an associated internal combustion engine for fuel injection and relates more particularly to a new and improved spill control mechanism for spill control of the high pressure fuel charges.

In a fuel injection pump of the type described, it may be desirable to control the size and/or timing of each high pressure fuel charge by a spill control system providing spill control of the beginning and/or end of the high pressure fuel injection event. For example, U.S. Pat. No. 4,376,432 of Charles W. Davis, dated Mar. 15, 1983, discloses a spill control system providing spill control of the end of the fuel injection event.

In U.S. Pat. No. 4,552,117 and copending application Ser. No. 779,201, several embodiments of a spill control mechanism are disclosed which employ one or more rotating fuel control valves for spill control of the high pressure fuel charges. Each rotating fuel control valve is mounted on the charge pump rotor and connected to the charge pump for spill control of the high pressure fuel charges. The high pressure fuel charges are precisely controlled with a high degree of repeatability and reliability over a long service free life.

The many advantages available from the invention disclosed in said copending application, include the capability to adjust the size of the injected fuel charge in a precise and simple matter and to vary the fuel injection timing in accordance with a change in the engine load and/or engine speed. The spill timing can be adjusted at the beginning and/or end of the fuel injection event by a variety of mechanical electrical, hydraulic and/or vaccum operated means driven by the fuel injection pump or the associated engine.

The present invention is directed to an improvement over the injection pump and spill control mechanisms described in said copending application, based on simplification of the structural and functional relationships between the spill control mechanism and the rotor and drive shaft with which it is associated. This simplification has, as its primary objective, the reduction of the dead volume and two-way traffic experienced by the fuel during the sequence of filling the pumping chamber, pressurizing and discharging the fuel, spill controlling the injection event, and refilling the pumping chamber.

Another object of the invention related to simplifying the spill control mechanism associated with the rotor, is to reduce the size and strength requirements for the rotor by minimizing the components required to be mounted thereon, and by isolating the rotor from the high stresses of the mechanism used to actuate the pumping chamber in the rotor.

A third object related to simplification of the spill control mechanism, is to eliminate the need for accumulators or similar components for the desired spill control, and to substitute a simple spill pressure regulating valve.

These and other objects are accomplished by mounting the rotating spill control valve transversely in the rotor, adjacent the pumping chamber. In the preferred embodiment of the invention, the spill control valve is centered on the longitudinal axis of the rotor and connected to the center of the pumping chamber by a short pump passage or bore. Pressurized fuel from the pumping chamber is forced through the pump passage and a transverse bore in the center of the spill valve, into an outlet passage for delivery to the outlet nozzle. The forces on the valve are balanced during this injection event. Inlet fuel enters the valve bore and passes through the spill valve through another transverse bore, which is fluidly connected to the pump passage. Thus, the dead volume and two-way traffic are experienced only in the pump passage. This passage can be made significantly shorter than the analogous passage or bore known in the art, because the center of the spill valve bore to which it is connected can be located substantially adjacent to the center of the charge pump, without encumbrance by the pump plungers or charge pump actuating components.

Mounting the spill control valve transversely within the rotor permits a further advantageous feature of the preferred embodiment, a headless rotor, i.e., the rollers and shoes typically used to actuate the pumping plungers can be mounted in the drive shaft rather than in the rotor. As compared with typical rotors, the preferred headless rotors is torque-free and thus can be smaller and constructed from a less costly material.

The transversely mounted spill control valve and associated simplification of the fill and injection passageways, permits yet another advantageous feature, a simple spill pressure regulating valve. A spill control passageway extends from the valve bore to the surface of the rotor that faces a corotating surface of, for example, the drive shaft. A simple check valve in the passageway is biased towards the valve bore by spring means mounted between the drive shaft and the rotor, to provide pressure regulation of the spill control passageway. The geometry of the rotating valve member within the valve bore provides a land surface trailing edge that interacts with the pump passage and the spill control passage, to accomplish end of injection spill control.

The adjustment of fuel injection timing and quantity are accomplished by means of a cam ring and associated adjusting ear, and by adjustment of the angular relationship between the rotor and rotor valve member. The timing adjustment is preferably accomplished by a dual piston arrangement acting as a force couple on opposite sides of the cam ring. The desired effects of such adjustment are, however, accomplished only by the interaction of end-of-cycle injection control with the control of the shape of the cam rise during the injection event.

BRIEF DESCRIPTION OF THE DRAWINGS

These and other features and advantages of the preferred embodiment of the invention can be better understood from the following more detailed description, in which reference is made to the accompanying drawings. FIGS. 1–29 illustrate the embodiments of the invention described in said copending application Ser. No. 779,201, and FIGS. 30–36 illustrate the improvements claimed hereinbelow.

In the drawings:

FIG. 1 is a longitudinal section view, partly broken away and partly in section, of a fuel injection pump incorporating a first embodiment of a spill control mechanism of the present invention;

FIG. 2 is an enlarged partial longitudinal section view, partly broken away and partly in section, of the fuel pump, showing a modified accumulator system of the spill control mechanism;

FIG. 3 is an enlarged partial transverse section view, partly in section, of the fuel pump;

FIGS. 4–7 are enlarged partial side views, partly broken away, of four embodiments of a fuel control valve member of the spill control mechanism;

FIG. 8 is an enlarged transverse section view, partly in section, of a modified rotor of the fuel pump;

FIG. 9 is an enlarged partial longitudinal section view, partly broken away and partly in section, of the modified rotor shown in FIG. 8;

FIG. 10 is an enlarged partial transverse section view, partly broken away and partly in section, of the modified rotor shown in FIGS. 8 and 9;

FIG. 11, 12 and 20 are enlarged partial transverse section views, partly broken away, showing embodiments of an adjustment device of the spill control mechanism;

FIG. 13–16 and 28 are enlarged partial longitudinal section views, partly broken away and partly in section, showing further modified embodiments of the spill control mechanism;

FIG. 17 is an enlarged partial transverse section view, partly broken away and partly in section, of a secondary fuel control valve of the spill control mechanism of FIG. 16;

FIGS. 18 and 19 are enlarged partial longitudinal section views, partly broken away and partly in section, showing further modified embodiments of the spill control mechanism of the present invention having solenoid and stepper motor operating systems respectively;

FIGS. 21–23 are enlarged partial transverse section views, partly broken away and partly in section of modified fuel control valves of the spill control mechanism;

FIGS. 24 and 25 are enlarged partial longitudinal section views, partly broken away and partly in section, showing modified spill port configurations employed in the fuel control valves of FIGS. 22 and 23;

FIG. 26 is a graph illustrating the effect of spill port restriction and leakage on the shape of a fuel injection event pressure pulse;

FIG. 27 is an enlarged partial longitudinal section view, partly broken away and partly in section, showing another modified accumulator system of the spill control mechanism;

FIG. 29 is a graph showing cam lobe displacement as a function of rotor angle;

FIG. 30 is a longitudinal, schematic view, partly in section, of a fuel injection pump incorporating the transversely mounted spill control valve of the present invention;

FIG. 31 is a schematic, transverse view of the fuel injection pump shown in FIG. 30;

FIGS. 32(*a*) and (*b*) are elevation and side views, respectively, of the fuel control gear of the fuel injection pump shown in FIG. 30;

FIGS. 33(*a*) and (*b*) are elevation and end views, respectively, of the portion of the drive shaft that mates with the rotor in the fuel injection pump shown in FIG. 30;

FIGS. 34(*a*) and (*b*) are elevation views of the rotary fuel control valve of the present invention, wherein the view in FIG. 34(*b*) shows the valve rotated 90 degrees relative to the view in FIG. 34(*a*);

FIGS. 35(*a*)–(*d*) are sectional views through the fuel control valve showing the end of filling, delivery, end of injection and filling stages of operation, respectively; and FIG. 36 is a longitudinal, section view of the fuel control valve during the filling stage as shown in FIG. 35(d).

DESCRIPTION OF THE RELATED INVENTION

Figure 1:
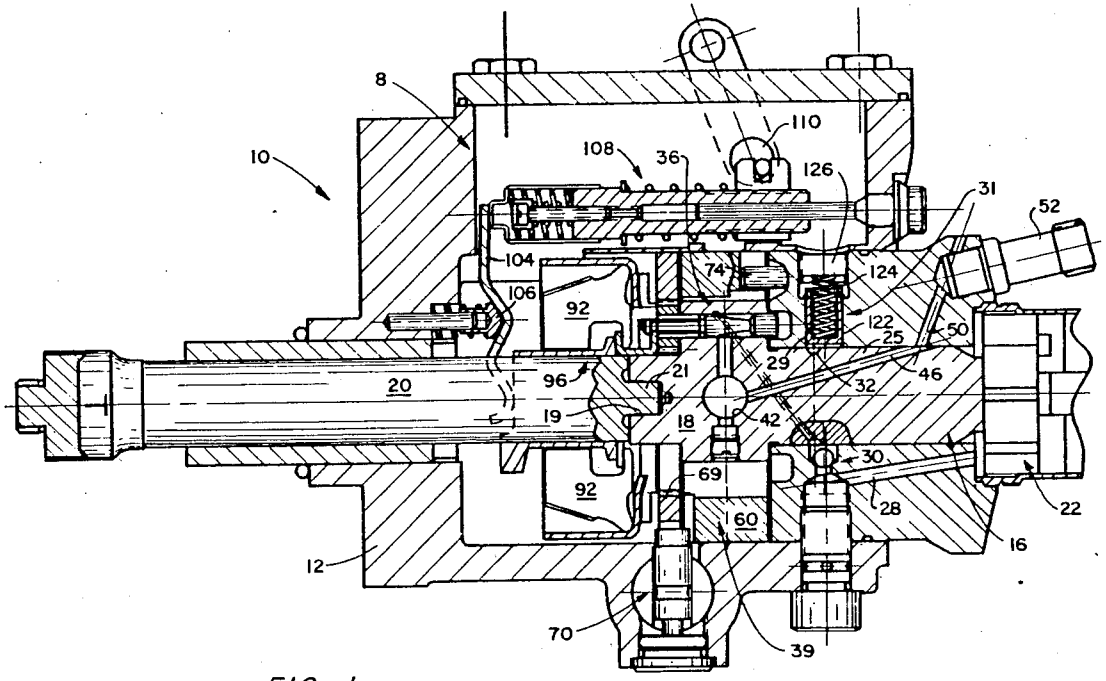

Referring now to the drawings in detail wherein like numerals are used to designate the same or like functioning parts, several embodiments of a spill control mechanism 8 of a related invention are shown for incorporation in a fuel injection pump 10 which is otherwise of generally conventional construction. The fuel injection pump 10 is operable for sequentially supplying measured charges of fuel under high pressure to the fuel injection nozzles (not shown) of an internal combustion engine (not shown). The pump 10 has a housing 12 and a rotor 16 with a rotor body 18 and a coaxial rotor drive shaft 20 journaled in the housing 12. The drive shaft 20 is adapted to be driven by the engine (not shown) conventionally at one half engine speed and is coupled or keyed to the rotor body 18 by a diametral slot 19 at the inner end of the rotor body 18 and a diametral tang or key 21 at the inner end of the shaft 20.

Figures 2, 3, 4:
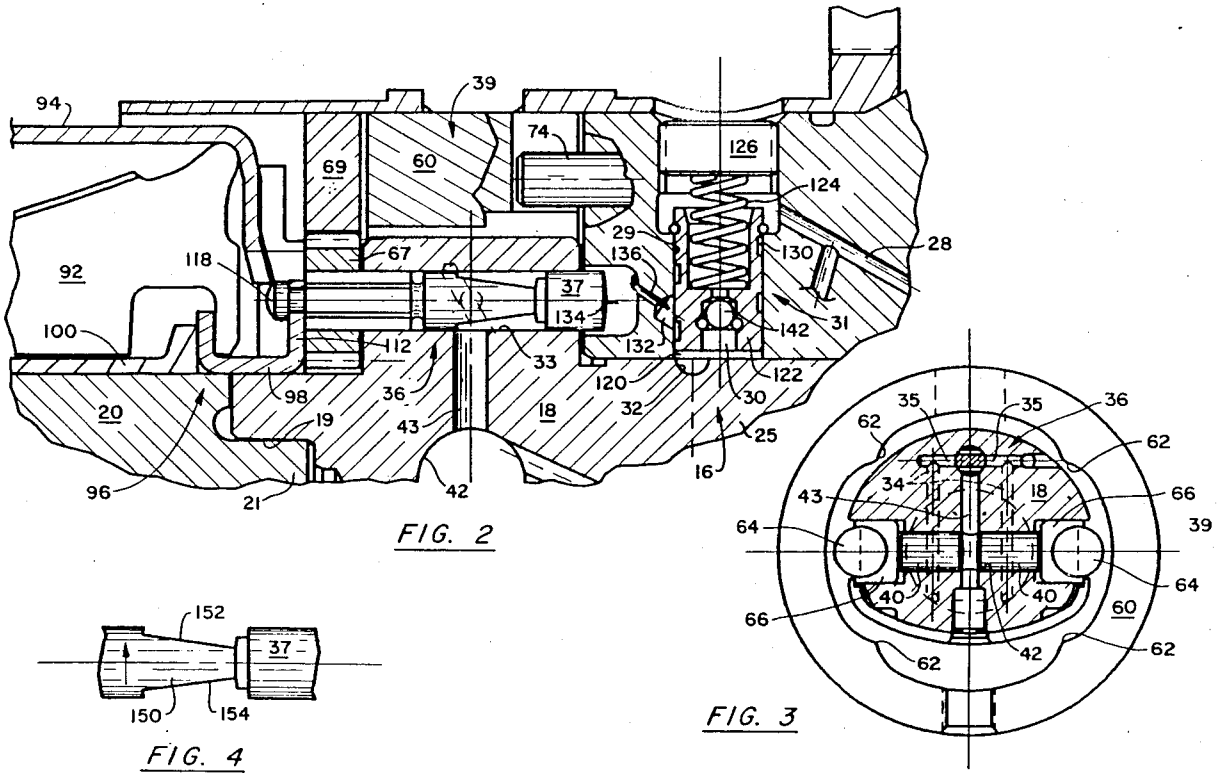
Figure 10:
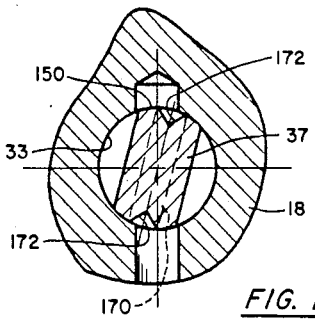
Figure 27:
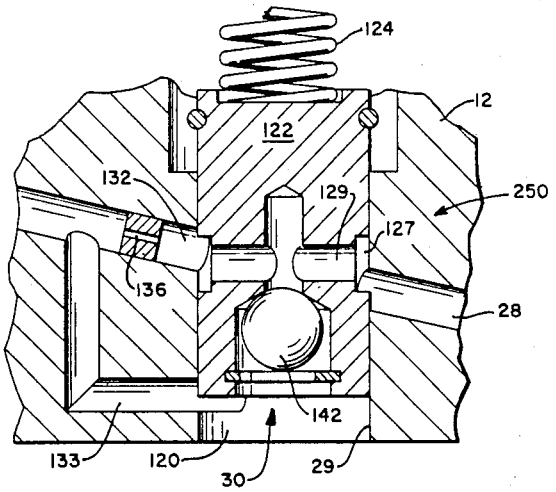

A vane-type fuel transfer pump 22 is provided at the outer end of the rotor body 18 for being driven by the rotor 16. The transfer pump 22 receives fuel from a fuel tank (not shown) and is connected to supply fuel at a transfer pressure to an external annulus or groove 32 in a stem 25 of the rotor body 16 via an inclined axial passage 28 and via either a combined one-way ball check valve 30 and accumulator 31 or 250 mounted in a radial bore 29 in the housing 12 (as shown in FIG. 2 or 27) or via only a one-way check valve 30 (as shown in FIG. 1). A rotary fuel control valve 36 has a cylindrical valve bore 33 within the rotor body 18, and in the embodiment of FIGS. 1–3, the external groove 32 is connected to the valve bore 33 via a pair of separate internal passages 34 in the rotor body 18 which lead to a pair of diametrically opposed valve ports 35. The axis of the valve bore 33 is preferably parallel to and radially spaced from the axis of the rotor 16, and a rotary valve member 37 of the valve 36 is mounted for rotation within the valve bore 33. In the embodiment of FIGS. 1-3, the rotary valve member 37 is also mounted for axial displacement within the valve bore 33.

A suitable pressure regulator (not shown) is provided for regulating the output or transfer pressure of the transfer pump 22. In a conventional manner, the pressure regulator provides a speed correlated transfer pressure which increases with pump speed for operating certain hydraulically actuated mechanisms of the fuel pump. Also, the housing preferably has a suitable pressure relief valve (not shown) to maintain the fuel pressure within the housing cavity at a constant relatively low level of for example 10 psi and to return excess fuel to the fuel tank.

A high pressure rotary charge pump 39 shown in FIG. 3 has a pair of diametrically opposed coaxial pumping plungers 40 mounted for reciprocation within a diametral bore 42 in the rotor body 18. The charge pump 39 receives fuel from the transfer pump 22 via the fuel control valve 36 and via a radial bore 43 in the rotor body 18 which connects the valve bore 33 to the center of the pumping plunger bore 42.

A fuel charge at high pressure is delivered by the charge pump 39 via an inclined axial outlet bore or distributor passage 46 (FIG. 1) in the rotor body 18. The distributor passage 46 extends from the center of the pumping plunger bore 42 and registers sequentially with a plurality of housing outlet passages 50 (only one of which is shown in FIG. 1) equiangularly spaced around the periphery of the rotor 16. The outlet passages 50 are angularly spaced to provide sequential registration with the distributor passage 46 during the inward compression or delivery stroke of the plungers 40. A suitable delivery valve (not shown) is mounted downstream of each outlet passage fitting 52 to achieve a sharp cut-off of fuel to the respective fuel injection nozzle and to maintain a high residual pressure in the downstream fuel delivery line (not shown) leading to the nozzle.

An annular cam ring 60 having a plurality of equiangularly spaced pairs of diametrically opposed cam lobes 62 is provided for simultaneously actuating the charge pump plungers 40 inwardly for delivering high pressure charges of fuel for fuel injection as the rotor 16 rotates. A roller 64 and roller shoe 66 are mounted on the rotor body 18 in radial alignment with each plunger 40 for actuating the plunger inwardly.

A satellite gear 67 is mounted on the rotary valve member 37 for engagement with an internal ring drive gear 69 mounted on the left side of the annular cam ring 60 as viewed in FIGS. 1 and 2. The satellite gear 67 is keyed to the rotary valve member 37 by means of a hexagonal opening in the gear 67 and a conforming transverse hexagonal section of the valve member 37 which permits the valve member 37 to be axially shifted within the satellite gear 67. The ring gear 69 is angularly adjustable but does not rotate with the rotor 16 and such that the valve member 37 is rotated within its mounting bore 33 in unison with the rotor 16 and in synchronism with the reciprocable movement of the pumping plungers 40. The gear ratio provided by the valve and ring gears 67, 69 is selected to provide for example exactly three or four full revolutions of the valve member 37 within its mounting bore 33 for each full revolution of the rotor 16, depending on the number and therefore angular spacing of the distributor outlet passages 50 and thus the design of the associated engine. Although the axis of the rotary control valve 36 is preferably parallel to the rotor axis as shown, the valve axis may be at an acute angle to the rotor axis or perpendicular to the rotor axis, in which event the valve drive gearing would be modified accordingly.

For adjusting the spill timing of the fuel injection event in correlation with engine speed, either (a) the annular cam ring 60 and gear ring 69 are angularly adjusted together by a suitable hydraulic timing actuator 70, or (b) only the annular drive ring 69 is angularly adjusted by a suitable timing actuator 70 as shown in FIG. 1, or (c) The annular cam ring 60 and gear ring 69 are independently angularly adjusted by separate actuators (for example with the cam ring 60 independently angularly adjusted by a suitable hydraulic timing actuator 70 and with the ear ring independently angularly adjusted by a separate suitable actuator. In case (a) and (c) above, the timing actuator 70 for example may be like that shown in U.S. Pat. No. 3,331,327 of V. D. Roosa dated July 18, 1967, or U.S. Pat. No. 4,476,837 of D. E. Salzgeber, dated Oct. 16, 1984. Also, in case (a) above, and the drive gear 69 is connected by suitable drive pins to be angularly adjusted with the cam ring 60, or the gear ring 69 is mounted to be angularly adjusted with the cam ring 60 and also relative to the cam ring, for example as shown in FIG. 12.

Figure 11:
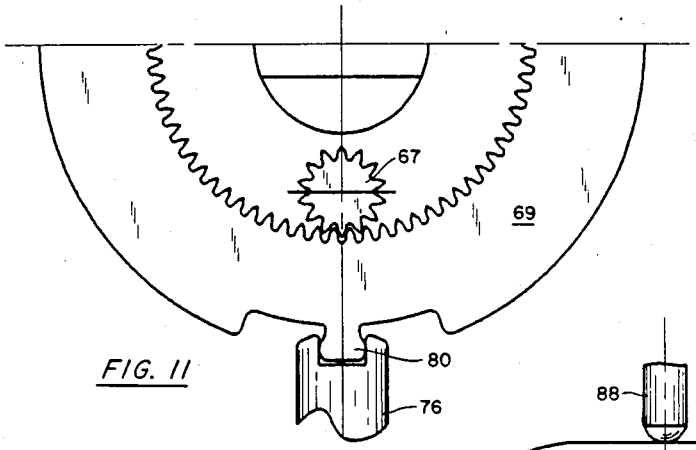

In case (b) above, an embodiment of which shown in FIG. 1, the cam ring 60 is fixed to the housing 12 by suitable locating pins 74 and for example as shown in FIG. 11 the gear ring 69 is connected to be angularly adjusted by the timing actuator 70 via an upstanding transverse pin 76 of the actuator 70. For that purpose, the pin 76 has a slot receiving a cylindrical projection 80 of the gear ring 69. Thus, in the embodiment shown in FIG. 1, the angular reaction force on the cam ring 60 resulting from the inward actuation of the pumping plungers 40 is transmitted directly to the housing and the hydraulic actuator 70 may be economically designed to provide only the relatively light force required for angular adjustment of the gear ring 69. Also, to minimize the force required for rotating and axially shifting the valve member 37 and to reduce valve wear and improve valve operation, the valve member 37 is hydraulically balanced within its mounting bore 33. For that purpose, the two diametrically opposed valve ports 35 are provided for balancing the hydraulic side forces on the valve member 37.

Figure 12:
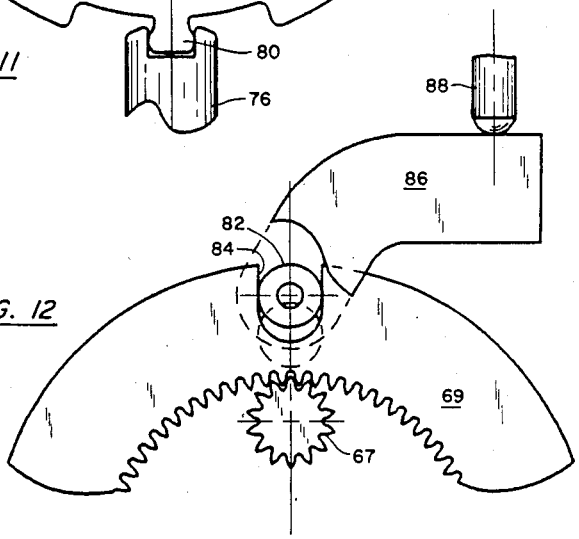

In the embodiment shown in FIG. 12, the gear ring 69 is mounted to be angularly adjusted relative to the cam ring 60 to provide a secondary timing control in addition to the primary control provided by the actuator 70. For that purpose, an eccentric or cam 82 is mounted on the cam ring 60 for receipt within a radial slot 84 in the gear ring 69. Rotation of the eccentric 82 by its operating arm 86 angularly adjusts the gear ring 69 relative to the annular cam ring 60 to provide secondary timing adjustment. The eccentric operating arm 86 is pivoted for example by a load responsive actuator 88 like that used for pivoting the spill collar operating arm in U.S. Pat. No. 4,376,432 of Charles W. Davis, dated Mar. 15, 1983.

Figure 20:
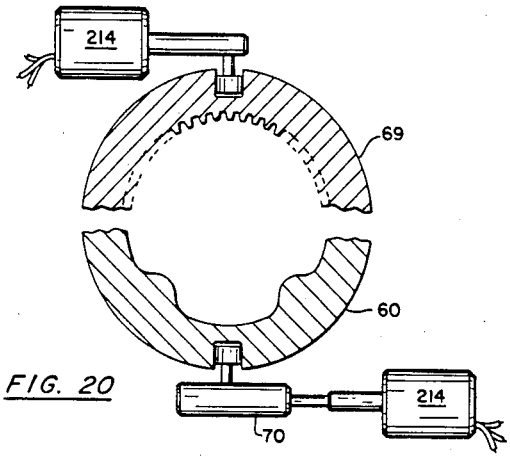

In case (c) above, in the example shown in FIG. 20, the gear ring 69 is angularly adjusted by a electrical stepper motor 214 and the hydraulic actuator 70 is independently operated by a separate electrical stepper motor 214.

Figure 29:
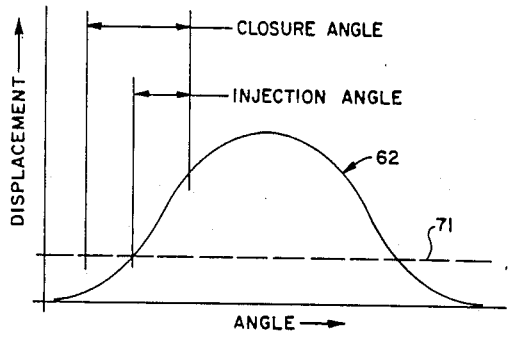

With the ring gear 69 and cam ring 60 separately adjusted as in the embodiments of FIG. 12 and 20, the dual angular adjustment can be used to provide both timing and load control. Such dual adjustment provides for selection of the cam lobe segment (and therefore the cam slope and fuel injection rate) that is effective during the fuel injection event. Use of the apex section of the cam lobe 62 (i.e. to provide over the nose fuel fuel injection) can be employed during starting and low engine speed operation, when the reaction force on the cam lobe 62 is less, to provide excess fuel for starting and/or a low injection rate. As illustrated in FIG. 29, the leading segment of the cam lobe 62 (i.e. the leading segment of the active part of the cam lobe 62 above a base line 71) can also be selected to provide a cam ring controlled start-of-injection adjustment and/or gear ring controlled load adjustment. Axial adjustment of the valve member 37 (as hereinafter described) may then be unnecessay or be used only to provide a secondary load or timing control, for example to govern engine speed as hereinafter described.

The present invention can be used with a governor and/or throttle mechanism in addition to or in place of the described adjustment of the cam ring 60 and ring gear 69 for controlling the engine load. Referring to FIGS. 1 and 2, a plurality of governor weights 92 (only two of which are shown in FIG. 1) are equiangularly spaced about the drive shaft 20 and are mounted in a suitable cage 94 attached to the rotor 16 to provide a variable axial bias on an axially shiftable collar 96. The collar 96 comprises a valve operating ring 98 which rotates with the rotor 16 and a non-rotatable sleeve 100 engaging the ring 98. The sleeve 100 engages a pivotal lever 104 to urge the lever 104 in the clockwise direction as viewed in FIG. 1 about its support pivot 106. The lever 104 is biased in the opposite pivotal direction by a governor spring assembly 108, which for example is identical to that disclosed in U.S. Pat. No. 4,142,499 of D. E. Salzgeber, dated Mar. 6, 1979. The opposing bias on the lever 104 provided by the governor spring assembly 108 is established by the angular position of a throttle operated shaft 110 (FIG. 1), and in a conventional manner the governor spring assembly 108 provides for both idle or minimum speed governing and maximum speed governing.

The valve operating ring 98 has a tang formed to provide an axially offset, radial projection or yoke 112 having a radial slot for receiving a reduced intermediate section of the rotary valve member 37. The valve member 37 is thereby connected to be axially shifted with the collar 96. A suitable circular compression spring is preferably mounted between the yoke 112 and an outer head 118 of the valve member 37 to eliminate any backlash between those parts. The quantity or size of the high pressure charge of fuel delivered by the charge pump 39 in a single inward pumping stroke of the pumping plungers 40 is controlled by varying the axial position of the rotary valve member 37. The opposing forces of the governor spring assembly 108 and governor fly weights 92 control the axial position of the valve member 37 to govern the engine at preestablished idle and maximum speeds. The throttle operated shaft 110 axially positions the valve member 37 throughout the full intermediate speed range of the engine.

The present invention can also be used with a governor spring assembly of the type used for full speed range governing and wherein the throttle operated shaft 110 is used to set the engine speed and the governor mechanism governs the fuel injection pump to maintain the engine speed at that speed setting. For example, a full speed range governor spring assembly may be used like that disclosed in U.S. Pat. No. 2,865,347 of V. D. Roosa, dated Dec. 23, 1958.

The fuel control valve 36 functions as both an inlet valve and a spill valve. In its function as an inlet valve, it provides for connecting the fuel supply ports 35 to the plunger bore 42 during the outward or intake stroke of the plungers 40. Fuel at transfer pump pressure is thereby supplied to the charge pump 39 preferably without restriction or inlet metering. The centrifugal force of the plungers 40 and the unrestricted fuel supply provides for fully charging the charge pump without cavitation and with the same full charge during each outward intake stroke of the pumping plungers 40.

The fuel control valve 36 provides spill control or spill timing at both the beginning and end or at only the beginning or end of the fuel injection event. In the embodiments shown in FIGS. 1, 2 and 27, spill control can be provided during both intervals, and the spilled fuel is returned to an accumulator chamber 120 at the inner end of the radial bore 29 in the housing 12. An accumulator piston 122 is mounted in the radial bore 29 and is biased to its inner limit position shown in FIG. 1 by a compression spring 124 having a preload established by an externally threaded, adjustable spring seat 126. A snap ring is mounted within an external annulus in the accumulator piston 122 to establish the inner limit position of the piston.

In the embodiment shown in FIG. 2, the outer generally cylindrical surface of the accumulator piston is provided with a helical groove 130 extending from the outer end of the piston 122 to an intermediate discharge port 132 connected to the pump housing cavity via a circular groove or annulus 134 in the housing 12 aligned with the valve member 37. The accumulator piston 122 is thereby cooled by a continuous flow of fuel helically around the accumulator piston. A suitable flow restrictor 136 is placed in the outlet passage connecting the intermediate outlet port 132 to the housing annulus 134 to regulate the rate of flow of fuel used for cooling.

In the embodiment shown in FIG. 2, the accumulator piston 122 has an inner axial bore, an outer axial bore providing a spring chamber for the accumulator spring 124 and an intermediate ball check valve 30 with a central valve port. A snap ring is mounted within the inner axial bore to retain the valve ball 142 adjacent its conical valve seat for quickly closing the check valve 30 when fuel is returned to the accumulator chamber 120.

In the embodiment shown in FIG. 27, the accumulator piston 122 has a peripheral annulus 127, a diametral bore 129 and the inner axial bore for delivering fuel via the ball check valve 30 to the charge 39. The discharge port 132 is located so that it is closed by the accumulator piston 122 when it is at its inward limit position. The accumulator piston 122 serves as a bypass valve which when displaced slightly outwardly, opens the discharge port 132 to permit bypass fuel flow from the transfer pump to minimize any enertia caused reduction of fuel flow to the charge pump 30 during the next fuel intake stroke of the pumping plungers 40. Also, a second discharge port 133 is opened after the port 132 to limit the amount of fuel accumulated in the accumulator chamber 120. Discharge port 132 is connected via a suitable restriction 136 to return fuel to the housing cavity.

The fuel accumulated during each inward or pumping stroke of the plungers 40 is redelivered to the charge pump 39 during the succeeding outward or intake stroke of the pumping plungers 40. The accumulator spring 124 is preferably preloaded to establish an accumulator pressure of for example approximately 200–300 psi which is significantly above the 40–100 psi transfer pressure range and significantly below the fuel injection pressure of up to 12,000 psi or more. During each intake stroke of the pumping plungers 40, the high accumulator pressure accelerates the fuel charging step to ensure complete fuel charging even at high pump speed.

Figure 28:
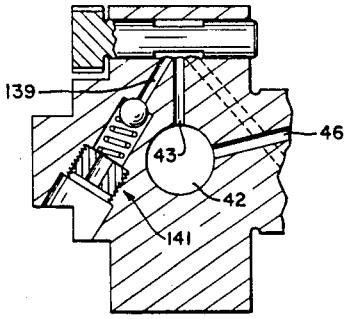

In the embodiment of the spill control mechanism shown in FIG. 28, a separate spill discharge passage 139 is provided in the rotor body 18 for returning the spilled fuel to the housing cavity. A one-way ball check valve 141 is provided in the spill discharge passage 139. That discharge check valve 41 and the inlet ball check valve 30 provide one way fuel flow to and from the rotary control valve 36.

Referring to FIGS. 2 and 4–7, the valve member 37 has a pair of identical diametrically opposed lands 150 for simultaneously opening and closing the two diametrically opposed valve ports 35. The radial connecting bore 43 preferably has a valve port which has a circumferential width greater than the maximum width of the lands 150 so that fuel is supplied without interruption to the charge pump 39 during the outward or intake stroke of the plungers 40 while the valve ports 35 are open. The two diametrically opposed lands 150 have diametrically opposed leading edges 152 for simultaneously closing the valve ports 35 and diametrically opposed trailing edges 154 for simultaneously opening the valve ports 35. In FIGS. 4–7, the circumferential width of the valve lands 150 varies along the axis of the valve member 37 so that the closed angular interval is dependent upon the axial position of the valve member 37. In the embodiment shown in FIG. 4, the leading and trailing edges 152, 154 taper toward each other in the retard and advance angular directions respectively. Alternatively, the leading edge 152 may be parallel to the axis of the valve member 37 as shown in FIG. 7, or (a) inclined in the advance direction as shown in FIG. 6 (to advance the fuel injection timing with load) or (b) inclined in the retard direction as shown in FIG. 5 (to retard the fuel injection timing with load). Likewise, the trailing edge 154 could be (a) inclined in the retard direction as shown in FIG. 5 or (b) inclined in the advance direction as shown in FIG. 6 as may be found desirable for any particular application. In each FIG. 4–7, the leading and trailing edges 152, 154 are related to provide a land 150 of decreasing circumferential width to decrease the angular interval as the valve member 37 is axially shifted to the left as viewed in FIG. 1. Also, the land segment which is effective at the fully retracted engine cranking position of the valve member is preferably enlarged to provide excess fuel for starting. In the alternative, when load control is provided by angular adjustment of the cam ring 60 and ring gear 69, the lands 150 have a constant width. In that event, the parallel leading and trailing edges may be inclined to the valve axis to provide timing control by axial adjustment of the valve member 37.

Thus, the size of the injected fuel charge and/or timing of the beginning and/or end of the fuel injection event can be spill controlled in accordance with the axial position of the valve 37. In addition, the fuel injection timing is controlled by angular adjustment of the ring gear 69 and/or cam ring 60. Where the ring gear 69 and cam ring 60 are axially adjusted together, the same segments of the cam lobes 62 are employed for the fuel injection event throughout the full load range of the engine and the rate of injection is established by the slope of those cam segments. If the cam ring 60 and ring gear 69 are relatively angularly adjustable, then the effective cam lobe segment can be shifted. In both cases, the shape of the cam lobes is optimized for the described spill control. The cam lobe shape and timing adjustment range are related so that during pump operation above idle speed, the fuel injection event is spill terminated before the pumping plunger actuating rollers 64 reach the apex or nose segment of the cam lobe 62 where the contact pressure on the cam lobe 62 would otherwise be the greatest. As a result, a fuel injection pressure of up to 12,000 psi or more can be delivered by the pump without creating an unacceptably high contact pressure on the cam lobes 62. Over the nose fuel injection can be employed during engine cranking and/or low engine speed (when the reaction force on the cam lobe 62 is relatively low due to the low pump speed) to provide excess fuel for starting and/or to decrease the fuel injection rate to produce more quiet combustion.

The valve ports 35 are closed twice during each revolution of the valve member 37. If the valve drive gearing 67, 69 provides for rotating the valve member 37 exactly four full revolutions for each revolution of the rotor 16, then the fuel control valve 36 is capable of providing a fuel injection event every 45 degrees of rotation of the rotor 16. Thus, the same gearing can be employed to provide either two, four or eight fuel injection events during one full revolution of the rotor 16 (and therefore two revolutions of the associated engine) depending on the number of pairs of diametrically opposed cam lobes provided on the cam ring 60. Similarly, gearing designed for rotating the valve member 37 exactly three full revolutions for each full revolution of the rotor 16 can be used to provide either three or six fuel injection events during one full revolution of the rotor 16. Also, gearing providing exactly two and one-half revolutions of the valve member 37 for every full revolution of the rotor 16 can be used to provide five fuel injection events per pump revolution (i.e. for a five cylinder engine and for example using a pumping plunger and plunger operating cam arrangement as disclosed in U.S. Pat. No. 4,255,097 of Charles W. Davis et al, dated March 10, 1981). Thus, the same basic pump design can be generally universally employed with minimum customization of parts for each engine application.

In view of the substantially higher rate of rotation of the valve member 37 than the rotor 16, the rotary valve 36 is quickly closed and opened to provide very precise spill control of the beginning and/or end of the fuel injection event. Accordingly, the rotating valve member 37 reduces the undesirable fuel restriction interval during port opening and closure and the undesirable fuel leakage interval just before the port opens.

The relatively small "dead" volume within the rotor 16 minimizes the effect of fuel compression on the size and timing of the fuel injection event. The valve member 37 is hydraulically balanced throughout its entire operating cycle to maximize valve reliability and minimize valve wear and the forces required for rotating and axially shifting the valve member 37. Since the periphery of the rotor body stem 25 does not provide spill valving as in conventional spill control systems exemplified by the system disclosed in U.S. Pat. No. 4,376,432, the diameter of the rotor body stem 25 and the cost of manufacture of the related pump structure can be reduced.

Figure 21:
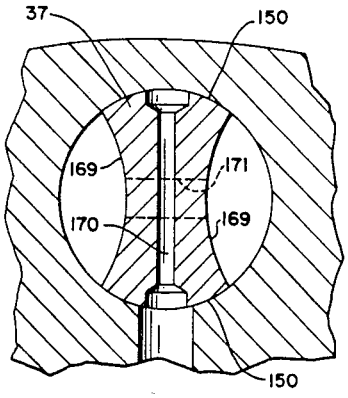

A modified rotor shown in FIGS. 8–19 has two intersecting diametral bores 42 and four equiangularly spaced pumping plungers 40. A single bore 162 is provided in the rotor body to connect the external groove 32 to the valve bore 33. That connecting bore 162 is offset from the valve bore 33 to provide a connecting port 164 having a circumferential dimension greater than the maximum circumferential width of the valving member lands 150 to preclude interruption of fuel flow to the charge pump during the outward intake stroke of the pumping plungers 40. The valve member 37 opens and closes a valve port 166 of a radial bore 168 connecting the valve bore 33 to the central intersection of the two pumping plunger bores 42. The "dead" volume of the high pressure fuel cavity of the rotor is thereby reduced. The connecting bore 168 crosses the valve bore 33 and the valve member 37 is formed with a diametral bore 170 and connecting axial channels or grooves 172 in its two diametrically opposed lands 150 to balance the hydraulic side forces on the valve member 37 without effecting the valve spill control. In a modified valve member 37 shown in FIG. 21, the ends of diametral bore 170 are enlarged to hydraulically balance the valve member. Also, the recessed portions 169 of the valve member 37 are concave to reduce the hydraulic impact torque on the valve member 37 during return spill flow to the control valve 36. In addition, a second diametral bore 171 (offset from bore 170) is provided in the valve member 37 between the recessed portions 169 to facilitate intake fuel flow to the pumping chamber.

Where, as in the embodiment of FIG. 8, a single valve port 35 provided by the radial bore 43 is employed for opening and closing the control valve 36, one of the two opposed valve lands 150 may not be used, depending on the number of valve member revolutions and injection events provided during each revolution of the rotor 16, in which event the unused land may be shortened or otherwise configured so as not to close the single valve port.

Figure 24:
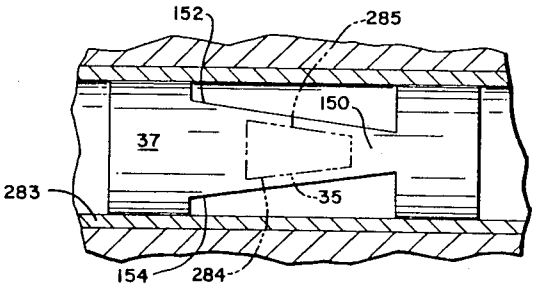
Figure 25:
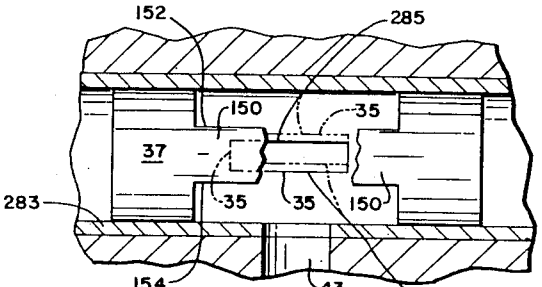
Figure 22:
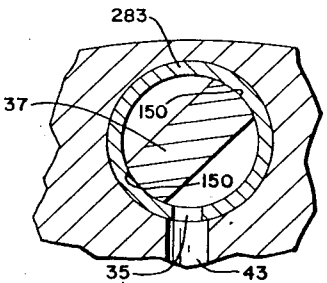
Figure 23:
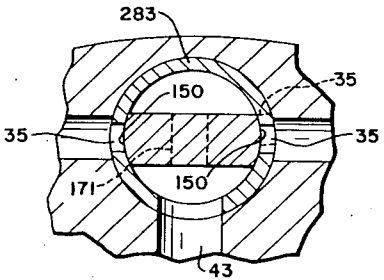
Figure 26:
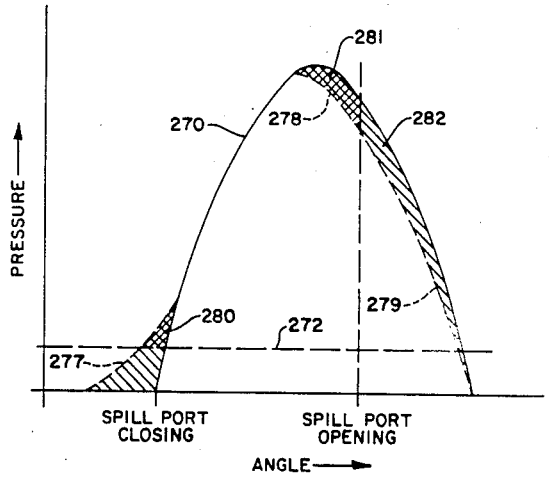

Referring to FIG. 26, the solid line curve 270 represents a pressure curve of an exemplary fuel injection event without fuel restriction during port closure or fuel leakage before port opening. The base line 272 represents the pressure at which the fuel injection nozzle (not shown) opens to begin injection. The broken line 277 represents the pressure variation caused by fuel restriction during port closure, the broken line 278 represents the pressure variation caused by fuel leakage before port opening and the broken line 279 represents the pressure variation caused by fuel restriction during port opening. The shaded areas 280–282 represent the variations in the fuel injection event caused by fuel restriction and fuel leakage. Both of those effects are substantially reduced by the rotation of the control valve 36 at a higher speed than the rotor 16. In addition, the spill valve ports can be configured and/or offset to further reduce such effects, for example as shown in FIGS. 22–25, wherein the valve ports 35 are shown provided by a valve sleeve 283. In FIGS. 22 and 24, a single spill port 35 is provided having a trapezoidal shape for more quickly opening and closing the spill valve 36. In FIGS. 23 and 25, a pair of diametrically opposed rectangular spill ports 35 are employed to more quickly open and close the spill 36. Also, in FIGS. 23 and 25, one of the two spill ports 35 is shown in broken lines slightly angularly offset so that one port 35 opens slightly before the other port 35 to adjust the effect of fuel leakage and fuel restriction. In all of the embodiments shown in FIGS. 22–25, the leading and trailing edges 284, 285 of the generally rectangular ports 35 are parallel to the trailing and leading edges 154, 152 respectively of the valve member 37.

Figure 13:
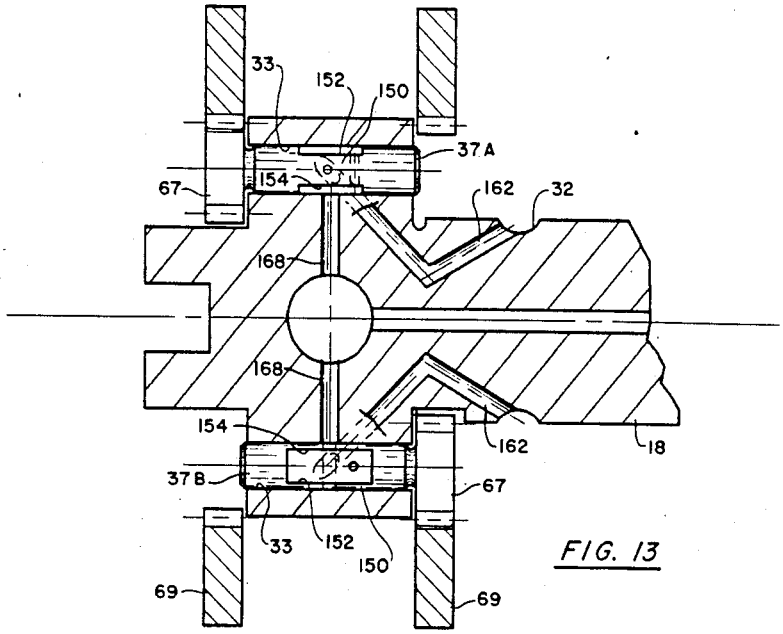

A modified rotor shown in FIG. 13 has two axial valve bores 33 and two corresponding preferably identical valve members 37A, 37B connected in parallel between the external groove 32 and two separate radial bores 168 leading to the pumping plunger bore(s). One of the valve members 37A is used for beginning of injection spill control and the other valve member 37B is used for end of injection spill control. The two valve members 37A, 37B are rotated by two separate ring gears 69 to provide separate and independent angular adjustment of the two valve members and therefore separate and independent spill control of the beginning and end of the fuel injection event. Separate angular adjustment of the cam ring 60 may also be provided as previously described. If the valve member 37A, 37B is axially adjusted, the leading and trailing edges 152, 154 of that valve member preferably are parallel to the axis of the valve member. One or both of the valve members could be axially adjusted as previously described and the diametrically opposed lands 150 of each axially adjusted valve member could be formed accordingly to provide the desired spill control. The two ring gears 69 are shown mounted at opposite axial ends of the control valves but may be mounted at the same axial end. The two gear rings 69 are independently angularly adjusted by separate linear actuators.

Figure 14:
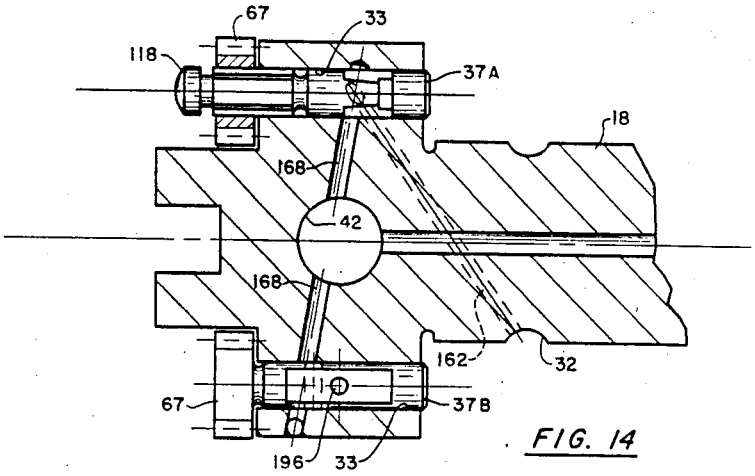
Figure 15:
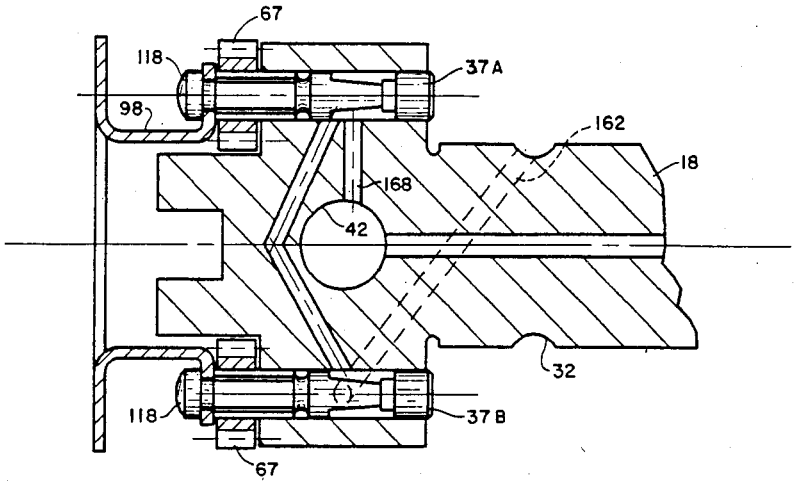
Figure 16:
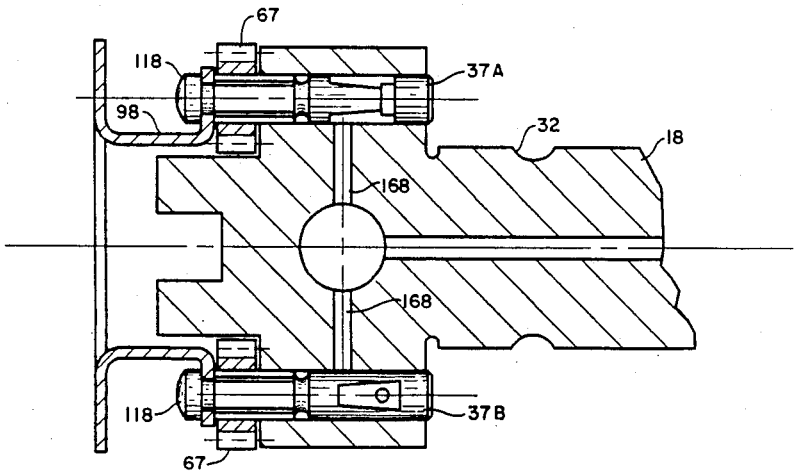

Three additional modified rotors shown in FIGS. 14-16 employ two fuel control valves 37A, 37B in the manner of the modified rotor 180 shown in FIG. 13 but for a different purpose. In FIGS. 14–16, the two valve members 37A, 37B provide for a two phase fuel injection event having a first high pressure pilot injection phase and an immediately succeeding main fuel injection phase. In FIG. 14, a primary valve member 37A functions in the same manner as the valve member 37 employed in the embodiment shown in FIGS. 1–3. A secondary or pilot fuel valve member 37B provides for momentarily relieving the high fuel injection pressure to provide separate pilot and main fuel injection phases. Both valve members 37A, 37B are rotated in synchronism by the same gear ring 69. Also, either both valve members, or as shown only the primary valve member 37A, is axially adjusted.

The high pressure is momentarily relieved, for example from 12,000 psi to 5,000 psi by momentarily connecting the charge pump 39 to an additional "dead" volume formed by recesses in the pilot control valve 37B. The pilot valve member 37B has a pair of intersecting diametral bores 196 for momentarily connecting the charge pump to that additional "dead" volume. The diametral bore 196 slightly overlaps the respective connecting bore 168 to provide a very short interval during which the high pressure is relieved. During the outward or inlet stroke of the pumping plungers 40, the additional "dead" volume is connected to the inlet or transfer pressure to relieve the "dead" volume pressure for the succeeding fuel injection event. The size of the "dead" volume is established to achieve the desired momentary pressure reduction by compression of the fuel in the additional "dead" volume. If needed, additional "dead" volume can be provided in the rotor body 18 in communication with the pilot valve bore 33. Alternatively, a suitable small volume spring biased accumulator piston (not shown) may be mounted in the rotor body 18 in communication with the pilot valve bore 33 to momentarily reduce the fuel injection pressure.

In the rotor embodiment shown in FIG. 15, the two fuel control valves 37A, 37B are connected in series for series spill control. The primary spill control valve 37A provides spill control of the beginning and end of the main fuel injection phase and the secondary or pilot fuel control valve 37B provides spill control of the beginning and end of the pilot injection phase. Both fuel control valves 37A, 37B are axially adjusted.

Figure 17:
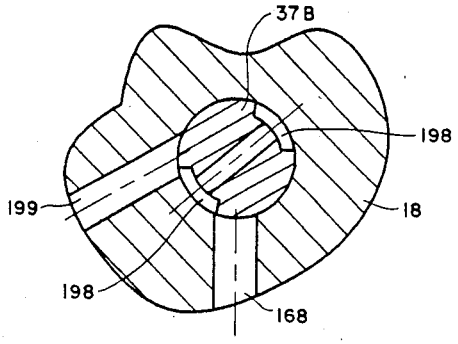

The rotor embodiment shown in FIG. 16 is similar to that shown in FIG. 15 except that in FIG. 16 the primary and secondary fuel control valves 37A, 37B are mounted in parallel as in FIG. 13 rather than in series as in FIG. 15. The primary valve member 37A provides spill control of the beginning and end of the entire fuel injection event. The secondary or pilot valve member 37B provides for momentarily relieving the high pressure for separating the fuel injection event into separate pilot and main fuel injection phases. For that purpose, the pilot valve member 37B momentarily connects the charge pump to the housing cavity via one of two diametrically opposed peripheral grooves 198 in the valve member 37B and via a bore 199 in the rotor body 18 as shown in FIG. 17.

Figure 18:
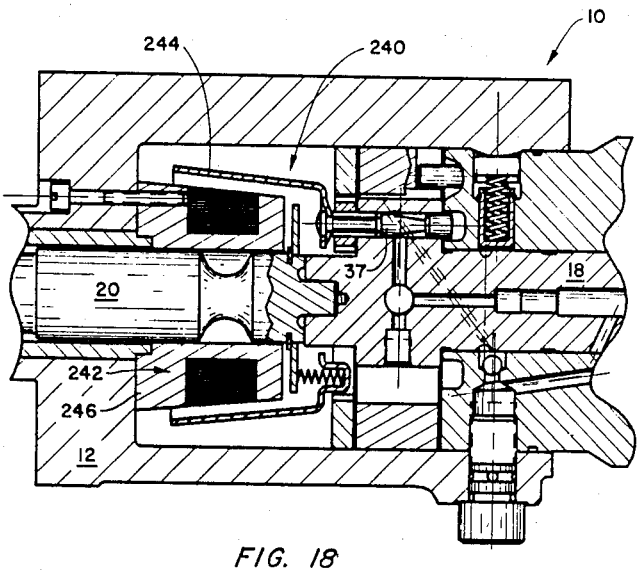
Figure 19:
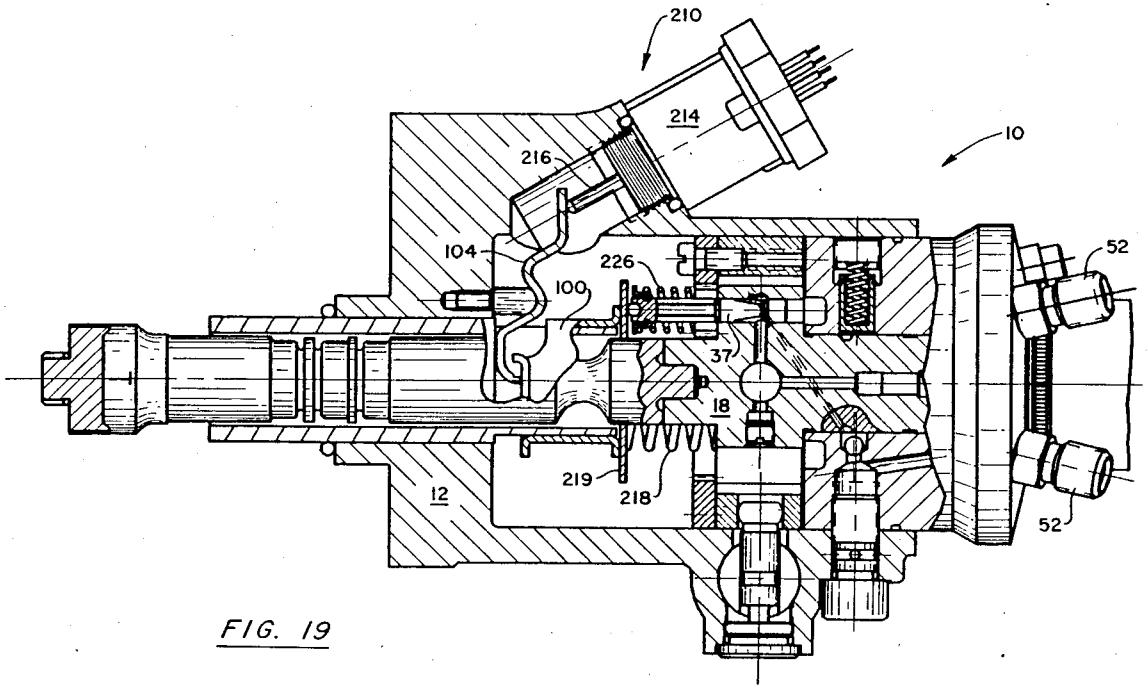

FIGS. 18 and 19 show two alternative mechanisms 210, 240 for axially positioning the fuel control valve member(s) 37. In FIG. 19 a bidirectional rotary stepper motor 214 having a linear actuating pin 216 is provided for axially positioning the valve member(s) via the lever 104 and sleeve 100. The sleeve 100 is biased in the opposite axial direction by a compression spring 218 mounted between the rotor body 18 and a thrust plate 219. The valve member(s) 37 are axially positioned by the thrust plate 219. For that purpose, a ball bearing 222 is mounted within a pocket in the outer end of the valve member 37 and the valve member 37 is biased outwardly by a compression spring 226 to urge the ball bearing into engagement with the thrust plate 219. A linear fuel quantity feedback sensor (not shown) is mounted within the pump housing 12 with its linear plunger engaging the thrust plate 219. The sensor supplies a signal to an electronic control unit (not shown) to complete a fuel quantity control loop.

In FIG. 18 the valve member(s) 37 are positioned by a solenoid 242 having an annular armature 244 coaxially mounted for rotation with the rotor 18 and connected to the valve member(s) 37. The armature 244 is axially shiftable by a fixed annular electromagnet 246 which encircles the rotor drive shaft 20. Therefore, the axial position of each valve member 37 is dependent upon the voltage applied to the electromagnet 246.

The several described embodiments of the spill control mechanism of the present invention can be used with a min/max or full speed range governor or with an electrical control as described. Also, it will be apparent that the different features illustrated in connection with the several embodiments of the invention disclosed herein may be utilized and incorporated in other embodiments as desired.

DESCRIPTION OF THE PREFERRED EMBODIMENT OF THE PRESENT INVENTION

FIGS. 30–36 illustrate another embodiment of a fuel injection pump having a rotating fuel control valve for spill control of the high pressure fuel charge, with the fuel control valve mounted on the charge pump rotor and connected to the charge pump. In this embodiment, the mounting on the charge pump rotor is transverse to the axis of the rotor, and preferably radially centered thereon. In the embodiment illustrated in FIGS. 1–29, the rotary spill control valve was mounted parallel to the rotor axis.

Since many features of the transversely mounted spill control valve and its relationship to the other components of the pump are similar to those described with respect to the parallel mounted valve, like reference numerals are used to describe the same or like function parts. Parts in FIG. 30–36 which have no counterpart in FIGS. 1–29 are identified by numerals beginning with 302.

Figure 30:
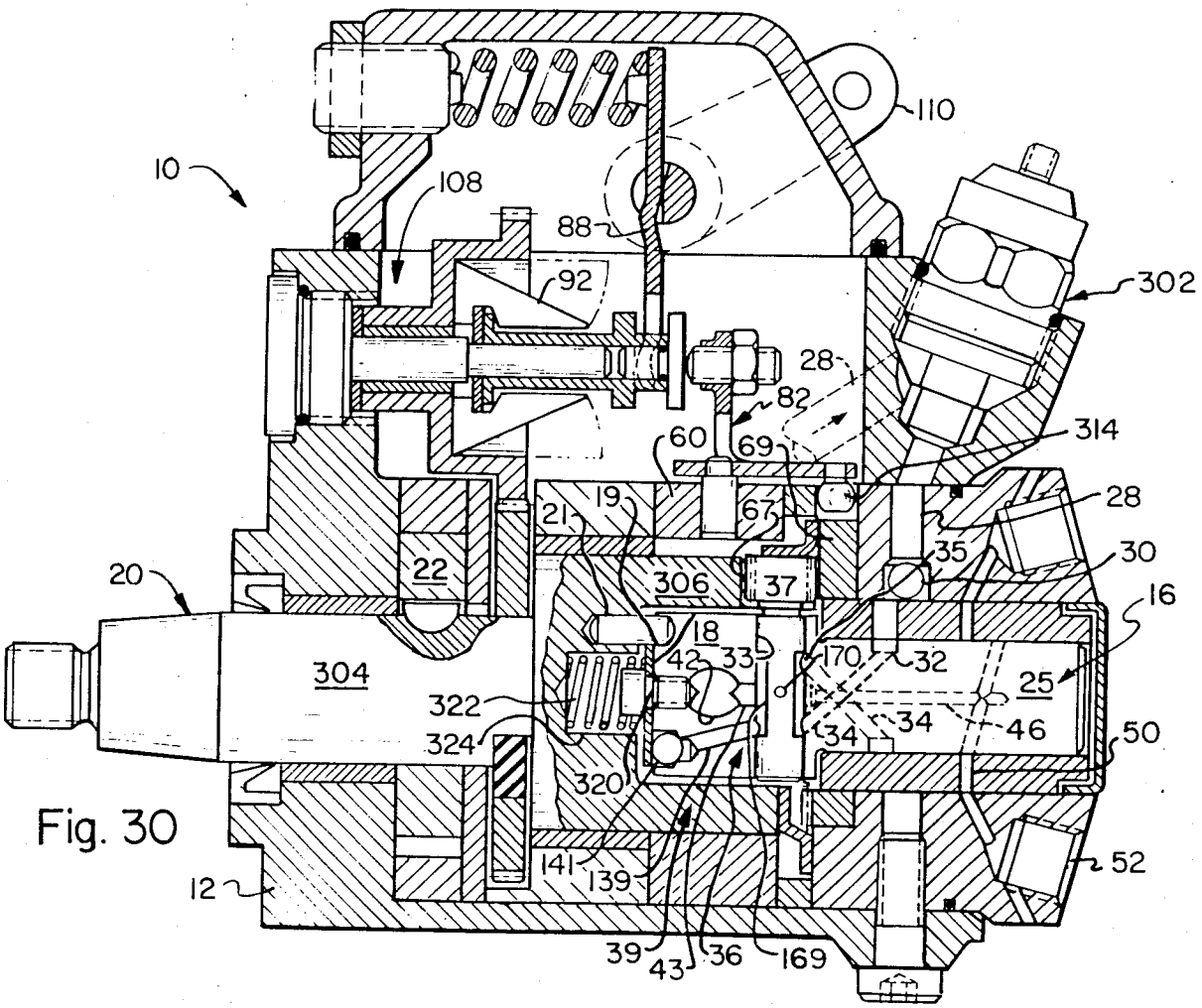

Referring now to FIG. 30, the fuel injection pump 10 has a housing 12 and a rotor 16 with a rotor body 18 and a coaxial drive shaft 20 journaled in the housing 12. The drive shaft 20 is mated to the rotor body 18 by means of a key or pin 21 engaging a receiving slot or bore 19 in the opposite member.

A fuel transfer pump, shown generally at 22, is preferably mounted in the housing and connected to the drive shaft for being driven by the drive shaft 20. The transfer pump 22 receives fuel from a fuel tank (not shown) and is connected to supply fuel through passages 28 to an external annulus or groove 32 in a stem 25 of the rotor body 16. Preferably, an electrical shut-off valve 302 is interposed in line or passage 28, between the transfer pump 22 and the annulus or groove 32. A one-way ball check valve 30 is mounted at the juncture of passage 28 and annulus 32.

A rotary fuel control valve 36 has a cylindrical valve bore 33 within the rotor body 18, mounted transversely to the axis of the rotor and preferably radially centered thereon. The external groove 32 is connected to the valve bore 33 via one or more separate internal passages 34 in the rotor 16 which lead to a pair of valve ports 35 on the same side of the bore 33. A rotory valve member 37 of the valve 36 is mounted for rotation but not axial displacement, within the valve bore 33.

Figure 31:
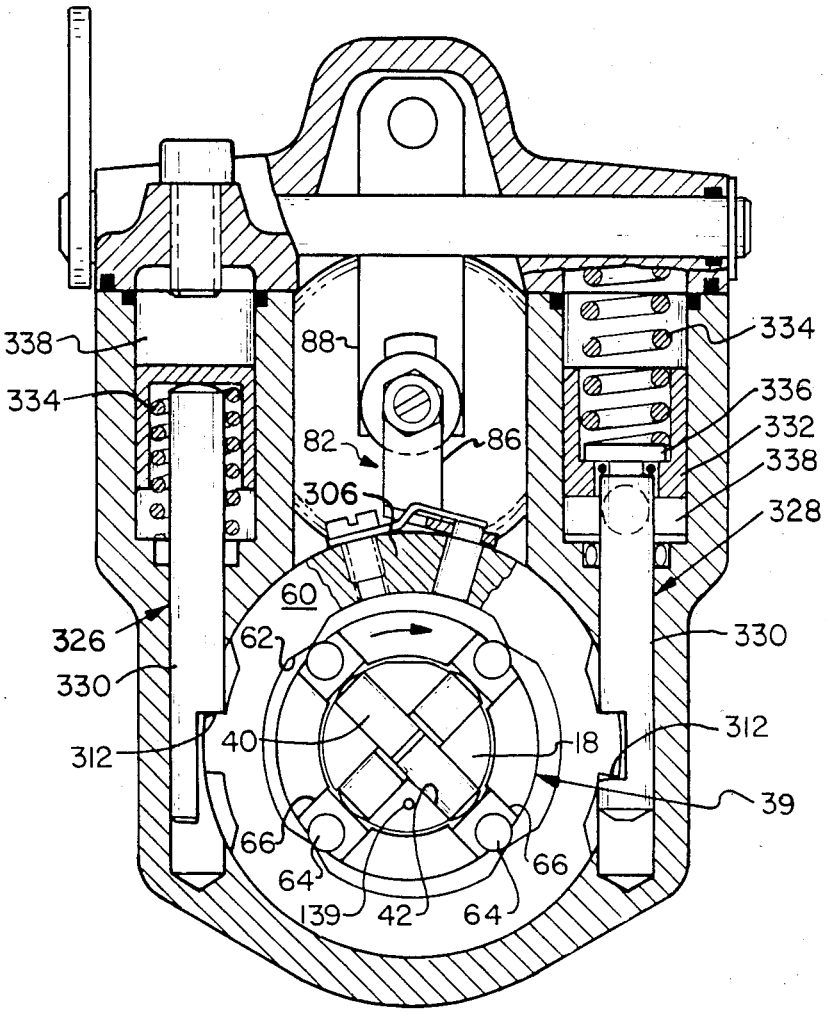

Referring now to both FIGS. 30 and 31, a high pressure rotary charge pump 39 has two pairs of diametrically opposed coaxial pumping plungers 40 mounted for reciprocation within diametral bore 42 in the rotor body 18. The charge pump 39 receives fuel from the transfer pump 22 via the fuel control valve 36 and via a bore or pump passage 43 in the rotor body which connects the valve bore 33 to the center of the pumping plunger bore 42.

A fuel charge at high pressure is delivered by the charge pump 39 via the pump passage 43, through the control valve 36 and to a distributor passage 46, which in turn registers sequentially with a plurality of housing outlet passages 50 equiangularly spaced around the periphery of the rotor 16. The distributor passage 46 is on the axis of the rotor 16 and the inlet passages 34 extend obliquely through the rotor on either side of the passage 46.

An annular cam ring 60 having a plurality of equiangularly spaced pairs of diametrically opposed cam lobes 62 is provided for simultaneously actuating the charge pump plungers 40 inwardly for delivering high pressure charges of fuel for fuel injection as the rotor head 18 and drive shaft rotate together. As shown in FIG. 33, the drive shaft 20 has a stem portion 304 and an enlarged diameter extension 306, the extension portion including means such as bore and/or key 21 to mate with corresponding receiving structure in the rotor 18. The extension portion of the drive shaft 306 includes a plurality of slots 308 for receiving the rollers 64 and roller shoes 66, and an opening 310 for accommodating the gear 67 extending from the valve member 37, as further described hereinbelow.

This embodiment of the invention thus incorporates the headless rotor feature, wherein the pump actuation members 64, 66 are mounted in the drive shaft extension 306, rather than the rotor 18. The high stresses associated with the interaction of the pump actuation member as they interact with the cam, are borne by the drive shaft. The cam ring is mounted in a stationary relationship relative to the rotating drive shaft 20, but is adjustable for control purposes as will be described below.

Referring now to FIGS. 30 and 32, a gear 67 is coaxially mounted on the rotary valve member 37 for engagement with an internal fuel control ring gear 69 which surrounds the rotor near the end of the drive shaft extension portion 306. The ring gear 69 is angularly adjustable relative to gear 67, but does not rotate with the rotor so that the valve member 37 is rotated within its mounting bore 33 in unison with the rotor 16 and in synchronism with the reciprocable movement of the pumping plungers 40. For adjusting the spill timing of the fuel injection event in correlation with engine speed, the coaxial cam ring 60 and ring gear 69 may be angularly adjusted either together, or independently, by conventional techniques adapted to the special relationship of the fuel control components associated with the present invention.

In FIG. 31, a unique control arrangement that is superior to mere adaptations of conventional control adjustment technique is shown for use with the present invention. The cam ring 60 is adjusted by means of a pair of control piston assemblies 326, 328. The displacement of the pistons is dependent on the fuel transfer pump pressure so that fuel control timing can be directly correlated to drive shaft rotation speed. In the illustrated arrangement, the notched engagement 312, 312' between the cam ring and the pair of piston assemblies 326, 328, not only permits adjustment of the cam ring 60 while avoiding side force, but also provides a balanced or shared resistence to the torque reaction forces resulting from the interaction of the roller 64 on the cam lobes 62.

Each control piston assembly 326, 328 has a rod member 330, a piston 332, means such as spring 334 for biasing the piston in one longitudinal direction, and a pressure chamber 338 for activating the piston 332. The piston members 326, 328 are connected in parallel as a couple to apply opposed tangential forces to the notches 312 on the outer circumference of the cam ring 60. Tranfer pump full pressure is supplied to pressure chambers 338 such that increasing tranfer pump pressure causes rod 330 to move downward and rod 338 to move upward, imparting a counterclockwise rotation to cam ring 60 through notches 312.

As shown in FIGS. 30, 31 and 32, the ring gear 69 is mounted to be angularly adjusted relative to the cam ring 60 to provide a secondary control in addition to the primary control provided by the piston actuator assemblies 326, 328. Viewed differently, this adjusts the angular position of the rotary spill valve member about its axis, relative to the angular position of the cam ring with respect to the axis of the rotor. A lever cam assembly 82 is mounted on the cam ring 60, having a ball lobe 314 which in turn mates with the recess 84 in the yoke extension 316 of the ring 69. Rotation of the lever assembly 82 by its operating arm 86 angularly adjusts the gear 69 relative to the cam ring 60 to provide secondary adjustment.

With the preferred arrangement whereby the ring gear 69 and cam ring 60 are separately angularly adjusted, the dual adjustment is used to provide both timing and load control. Such dual adjustment provides for selection of the cam lobe segment (and therefore the cam slope and fuel injection rate) that is effective during the fuel injection event. Axial adjustment of the valve member 37, as described above with respect to a related invention, is unnecessary. Further, as described in connection with the related invention, the present invention can be used with a governor and/or throttle mechanism, generally identified in FIG. 30 by reference numerals 108, 92, and 110.

The present invention relates generally to fuel injection pumps of the type having a rotary charge pump with one or more reciprocating pumping plungers for sequentially supplying measured charges of fuel under high pressure to an associated internal combustion engine for fuel injection and relates more particularly to a new and improved spill control mechanism for spill control of the high pressure fuel charges.

Figure 35:
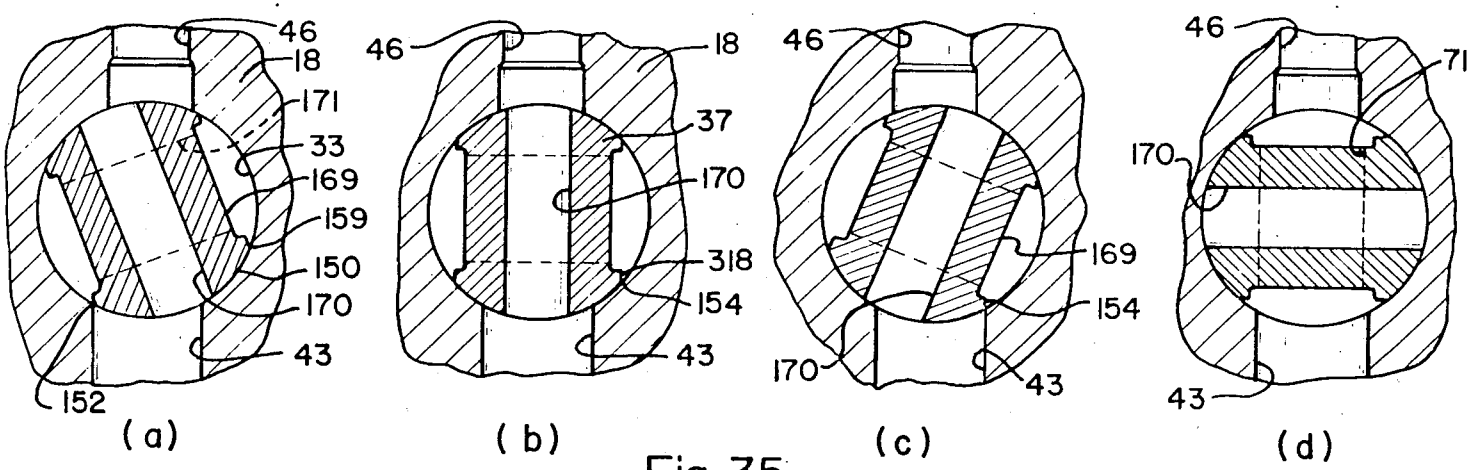
Figure 36:
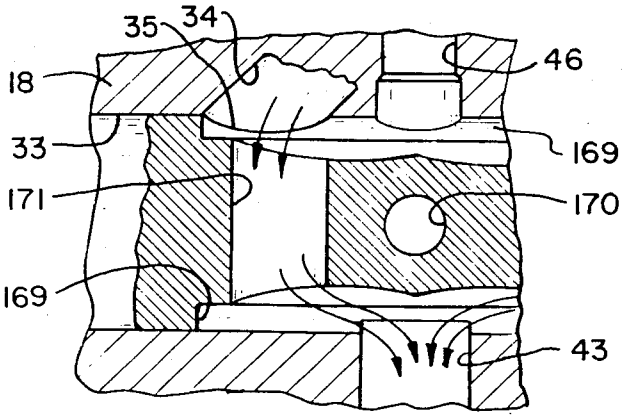

The operation of the rotary fuel control valve 36 will now be described in greater detail with reference to FIGS. 30, 34, 35, and 36. The fuel control valve 36 functions as both an inlet valve and a spill valve. The valve member 37 has a pair of identical diametrically opposed lands 150 which are adapted to closely fit the walls of the bore 33 in the rotor head 18. A first diametral bore 170 is centered in the valve member 37 such that it connects the pump passage 43 to the discharge passage 46 during the fuel delivery stage of the pumping cycle, as shown in FIG. 35(*b*). In FIG. 35(*a*) to (*d*), the valve member 37 is shown rotating clockwise. During the filling stage shown in FIG. 35(*d*) and FIG. 36, one and preferably two second diametral bores 171 spaced from and transverse to the first bore 170, connect the inlet ports 35 of the inlet passages 34 to the pump passage 43. As shown in FIG. 36, during the filling stage of the pumping cycle, the fuel travels through bore 171, along recesses 169 and into pump passage 43, as well as into discharge passage 46. Typically, the inlet passage 34 intersects the valve bore 33 obliquely, forming an enlarged port 35 that provides ample flow area for a rapid filling. FIG. 36 shows only one of the bores 171 and it should be recognized that the operation of the filling stage in the valve bore 33 is symmetric with respect to the passages 43, 46, when two inlet ports 35 are located on either side of passage 46.

It should be appreciated that, as compared with prior fuel control valve designs, the present invention reduces the dead volume and further reduces potential filling problems in fuel passageways due to two-way fuel traffic. The only volume of fuel subjected to two-way traffic is in the pump passage 43, the length of which is minimized as a result of the radial mounting of the control valve 37 in the rotor head 18 adjacent to the pumping chamber or bores 42. The rotary valve member 37 alternatingly connects the pump passage 43 with at least one inlet passage 34 and the discharge passage 46.

As shown in FIG. 34, the valve member 37 has a substantially cylindrical profile and a pair of recesses 169 at opposite ends of the second transverse bores 171. The recesses 169 are shaped substantially in the form of a curved rectangle, elongated along the axis of the valve member. These recesses define diametricly opposed leading edges 152 and diametricly opposed trailing edges 154 on the land surfaces 150.

As shown in FIG. 35(*a*), the end of filling point has been reached whereby leading edge 152 has sealed the pump passageway 43, preventing flow from inlet passages 34 (not shown but in a planes above and below the plane of the figure), to pass through bores 171 and recesses 169 into the pump passageway 43. Preferably, the inlet bores 35 are larger than the pump passageway 43 or outlet passage 46, such that the inlet bores 35 are never fully closed. At the moment illustrated in FIG. 35(*a*), compression in the pumping chamber can begin and by the time the valve has rotated clockwise into the position shown in FIG. 35(*b*) full fuel delivery at peak pressure is occurring. With the first bore 170 aligned with the pumping passage 43 and discharge passage 46, the forces acting on the valve member 37 are balanced, thereby avoiding torque effects that can be transmitted to associated components and diminish their life expectancy or performance characteristics. Preferably, the passages 43, 46 project an approximately equal area onto the land surfaces 150, but the shape of the passages need not be the same. For example, the preferred shape of the pump passage 43 is square, to provide a sharper discontinuity as the trailing edge 154 intersects the passageway 43, whereas passageway 46 may be round.

In FIG. 35(*c*), the moment at which the trailing edge 154 intersects the pump passage 43, is illustrated. At this moment, end of injection spill control is achieved because the high pressure fluid that is being delivered from pump passage 43 through bore 170 experiences a pressure relief path as trailing edge 154 exposes the high pressure fluid to the lower pressure in recess 169. The end of injection spill control is achieved before the flow path from passage 43 through bore 170 to passage 146, is completely closed off. In this way, end of injection spill control through pressure relief provides a quicker and more precise control than is possible by reliance upon the closure of outlet passage 46, or diversion of fuel at injection pressure to an accumulator. The pressure relief is further enhanced by providing the recesses 169 with flared portions 318. The pressure pulse generated in the recess 169 as a result of the end of injection spill control, is transmitted from the valve bore to the surface of the rotor by means fo spill control passage 139. Preferably, the spill control passage terminates at the end of the rotor 18 that faces the drive shaft extension 306. A ball check valve 141 is located in the spill control passage, and biasing means such as a spring 322 is mounted on the drive shaft, such as in bore 324 for urging the ball 141 toward the control valve bore 33. Preferably, a plate 320 is interposed between the spring 32 and the rotor head 18, the plate having an outer portion in contact with the ball 141. The spring 32 also serves to cushion any axial forces between the drive shaft 20 and the rotor 16 that may be externally imposed upon the pump. During spill control through the spill control passage, check valve 30 prevents backflow through the inlet passages 34.

The preferred embodiment of the invention having been described, it should be appreciated that, in addition to previously mentioned advantages, the preferred embodiment of the invention provides other, subtle advantages. Relative to the described embodiment of the related invention, the present invention provides engagement between the valve and the stationary face or ring gear, that is insensitive to axial backlash of the valve. Radial valve backlash is eliminated by the action force of the spill pressure regulator spring. When the electronic shut off valve is used, actuation of the shut-off valve interrupts fuel flow, and no filling is possible as could occur through the spill holes in other designs.

With the headless rotor implementation of the present invention, backlash in the drive system is eliminated, thereby reducing wear and increasing advance and fuel metering accuracy. Side loads on the rotor shaft are eliminated, thereby significantly reducing the likelihood of rotor seizure. The rigid drive shaft suspension accommodates a very powerful transfer pump and makes belt drive applications easier.

The tandem advance provided by the pair of pistons acting on the cam ring, increases effective advance plunger area without increasing the pump size, which results in reduction of the pressure generated in the chamber by pumping reaction force. Excessive pressure has been responsible for advance collapsing wear because of gravitation and spring action of the compressed fuel. The action and reaction torque on the cam is distributed between two plungers, which eliminates or reduces the reaction force between the cam ring and the housing, which has in the past often been responsible for wear and breakage.

What is claimed is:

1. In a rotary fuel injection pump for an internal combustion engine, having a housing, a rotor rotatable in the housing, a charge pump having a plurality of radially extending plunger bores in the rotor and a plunger pump for each plunger bore having a pumping plunger reciprocable in the bore, the pumping plunger having outward fuel intake strokes and inward fuel delivery strokes for supplying high pressure charges of fuel for fuel injection, a cam ring surrounding the rotor and engageable with the plunger pumps to reciprocate the plungers as the rotor rotates, and a spill control mechanism having spill valve means connected to the charge pump for spill control of said high pressure charge of fuel, the improvement wherein:

the spill valve means comprises at least one rotary spill valve having a valve bore in the rotor oriented transversely to the axis of the rotor and connected to the charge pump through pump passage means and a rotary spill valve member rotatably mounted within the valve bore; and the spill control mechanism includes means for rotating the rotary spill valve member in unison with the rotor and in synchronization with the reciprocable movement of the pumping plungers for spill control of the high pressure charge of fuel.

2. The fuel injection pump of claim 1 wherein said charge pump is centered on the axis of the rotor, said pump passage means extends coaxially along the axis of the rotor and said valve bore is centered on the axis of the rotor adjacent the plunger bores of the charge pump.

3. The fuel injection pump of claim 2 wherein said rotor further includes at least one fuel inlet passage from the surface of the rotor to said valve bore and a fuel discharge passage from the valve bore to the surface of the rotor; and said rotary valve member includes means for alternatingly connecting said pump passage means with one of said inlet passages and said discharge passage.

4. The fuel injection pump of claim 3 wherein the means for alternatingly connecting said pump passage has a substantially cylindrical profile defining land surfaces for closely engaging the valve bore and further includes, a first transverse bore for registration with the pump passage means and the discharge passage means;

at least one second transverse bore for respective registration with said at least one fuel inlet passage; and a pair of recesses on the surface of the valve member, at opposite ends of said at least one second transverse bore, for connecting said second bore with said pump passage.

5. The fuel injection pump of claim 4 wherein the lateral edges of said recesses are flared.

6. The fuel injection pump of claim 4 wherein said recesses are shaped substantially in the form of a curved rectangle elongaged along the axis of the valve member.

7. The fuel injection pump of claim 4, wherein said rotor further includes spill control passage means extending from said valve to the surface of the rotor for periodic alignment with said recesses, and wherein the geometric relationships of said land surfaces, said recesses, and said first bore are such that when the rotating valve member rotates within the bore, said recesses are connected for fluid communication with from said pump passage to said spill control passage before the flow path from said pump passage to said discharge passage through said first bore, is closed by said land surfaces closing said discharge passage.

8. The fuel injection pump of claim 4 wherein said rotor further includes spill control passage means extending from the valve bore to the surface of said rotor.

9. The fuel injection pump of claim 8 wherein said rotor is mated at a first end to a drive shaft for corotation within said housing, and wherein said spill control passage terminates at the surface of said first end of the rotor.

10. The fuel injection pump of claim 9 wherein said spill control flow passage periodically connects with said recesses on the rotating valve member;

said inlet passage includes check valve means preventing flow away from said bore;

wherein said spill passage means includes a check valve near the surface of said rotor;

whereby high pressure fuel spilled into said recesses is conducted through said spill control passage rather than through said inlet passage.

11. The fuel injection pump of claim 1 further including a drive shaft rotatably mounted coaxially with said rotor;

means for connecting the drive shaft to the rotor such that the drive shaft and rotor rotate in unison; and charge pump actuation means carried on said drive shaft between said cam ring and said rotor for engaging the cam and said plungers to reciprocate said plungers within the plunger bores.

12. The fuel injection pump of claim 11 wherein said charge pump actuation means are mounted on an enlarged diameter extension of the drive shaft, at least a portion of said extension surrounding said valve bore.

13. The fuel injection pump of claim 1 further including, a drive shaft mounted within the housing to one end of the rotor for imparting rotational motion thereto, spill control passage means extending from said valve bore to said one end of the rotor;

means located between the drive shaft and said one end of the rotor and rotatable therewith for providing a predetermined pressure relief set point in said spill control passage.

14. The fuel injection pump of claim 13 wherein said means for providing pressure relief include a ball check valve located in the spill control passage, and biasing means mounted on the drive shaft for urging the ball toward said valve bore.

15. The fuel injection pump of claim 13, wherein said rotor further includes at least one fuel inlet passage from the surface of the rotor to said valve bore and a fuel discharge passage from the valve bore to the surface of the rotor; and said rotary valve member further includes means for alternatingly connecting said pump passage means with one of said inlet passages and said discharge passage, and means for selectively connecting said pump passage to said spill control passage.

16. The fuel injection pump of claim 1 wherein said means for rotating the rotary spill member include first means for adjusting the angular position of the rotary spill valve member about its axis, relative to the angular position of said cam ring about the axis of the rotor.

17. The fuel injection pump of claim 16 further including second adjusting means connected between said cam ring and said housing for adjusting the angular position of said cam ring relative to the axis of said rotor.

18. The fuel injection pump of claim 16 wherein said means for rotating the rotary spill member comprises a stationary ring gear coaxially disposed around said rotor;

gear means on the rotary spill valve member engageable with the gear ring means to impart rotation to said valve member as said rotor rotates about its axis; and said first means for adjusting include means mounted on said housing for adjusting the angular position of said ring relative to the axis of said rotor.

19. The fuel injection pump of claim 1 further including means for adjusting the angular position of said cam ring relative to the axis of said rotor, said means comprising a pair of piston assemblies arranged at opposite sides of the cam ring and engaging the cam ring for applying a force couple to the ring having a magnitude commensurate with the speed of the engine.

20. The fuel injection pump of claim 19 wherein said piston assemblies each include a piston chamber fluidly connected to a source of pressure that is commensurate with the speed of the engine.

21. The fuel injection pump of claim 20 further including a drive shaft and fuel transfer pump driven by the drive shaft for delivering fuel to said spill valve means, and wherein said piston chambers are fluidly connected to the outlet side of said fuel transfer pump.

22. In a rotary fuel injection pump for an internal combustion engine, having a housing, a rotor rotatable in the housing, a charge pump having a plurality of radially extending plunger bores in the rotor and a plunger pump for each plunger bore having a pumping plunger reciprocable in the bore, the pumping plunger having outward fuel intake strokes and inward fuel delivery strokes for supplying high pressure charges of fuel for fuel injection, a cam ring surrounding the rotor and engageable with the plunger pumps to reciprocate the plungers as the rotor rotates, and means for adjusting the angular position of said cam ring relative to the axis of said rotor to alter the timing of the delivery stroke, wherein the improvement comprises:

said means for adjusting the angular position of said cam ring include a pair of piston assemblies arranged at opposite sides of the cam ring and engaging the cam ring for applying a force couple to adjust the ring and for sharing the reaction forces on the ring resulting from the interaction of the cam ring and said plunger pumps.

23. The fuel injection of claim 22 wherein said piston assemblies each include a piston chamber fluidly connected to a source of pressure that is commensurate with the speed of the engine.

24. The fuel injection pump of claim 22 further including a drive shaft and fuel transfer pump driven by the drive shaft for delivering fuel to said charge pump, and wherein said piston chambers are fluidly connected to the outlet side of said fuel transfer pump.

25. The fuel injection pump of claim 22 wherein each of said piston assemblies has a rod member, a piston, means for biasing the piston in one longitudinal direction, and a pressure chamber including pressurized fluid for actuating the piston such that the rod member is moved tangentially relative to the cam ring circumference.

26. The fuel injection pump of claim 25, wherein said pressurized fluid in said piston assembly is commensurate with the rotation speed of said drive shaft.

27. The fuel injection pump of claim 22, wherein each of said piston assemblies includes an elongated rod member extending substantially tangentially to the circumference of said cam ring, and wherein said rod and said cam ring are in notched engagement with each other.

* * * * *